United States Patent [19]

Dennetiere

[11] 4,275,698

[45] Jun. 30, 1981

[54] INTERNAL COMBUSTION ENGINE OF THE TYPE HAVING TWO INLET VALVES PER CYLINDER

[75] Inventor: André Dennetière, Saint Saulve, France

[73] Assignee: Duvant, S.A., Paris, France

[21] Appl. No.: 902,356

[22] Filed: May 3, 1978

Related U.S. Application Data

[63] Continuation of Ser. No. 635,913, Nov. 28, 1975, abandoned.

[30] Foreign Application Priority Data

Dec. 3, 1974 [FR] France ..... 74 39487

[51] Int. Cl.[3] ..... F02M 21/02

[52] U.S. Cl. ..... 123/527; 123/90.41; 123/432

[58] Field of Search ..... 123/90.22, 90.4, 90.41, 123/75 B, 432, 525, 527, 52 M

[56] References Cited

U.S. PATENT DOCUMENTS

| | | | |
|---|---|---|---|
| 1,172,358 | 2/1916 | Herkt | 123/90.22 |
| 1,899,869 | 2/1933 | Heusser | 123/527 |
| 1,915,237 | 6/1933 | Moore | 123/432 |
| 3,374,775 | 3/1968 | Ferguson | 123/75 B |
| 3,428,032 | 2/1969 | Rudert | 123/90.4 |
| 3,967,601 | 7/1976 | Heberle | 123/90.4 |
| 3,967,611 | 7/1976 | Goto | 123/75 B |

FOREIGN PATENT DOCUMENTS

| | | | |
|---|---|---|---|
| 223913 | 6/1957 | Australia | 123/75 B |
| 1436751 | 5/1973 | United Kingdom | 123/75 B |

*Primary Examiner*—Ronald H. Lazarus

*Attorney, Agent, or Firm*—Gottlieb, Rackman & Reisman

[57] ABSTRACT

Internal combustion engine of the type comprising a pair of inlet valves per cylinder which are actuated by a single common rocker, the inlet ports formed by said valves and the relevant seats communicating with an external source of fluid via an induction duct formed in the cylinder-head of the engine. A respective induction duct is formed in the cylinder-head for each inlet port whereby these ports may, according to the mode of operation of the engine, be connected to corresponding external sources of gaseous fluid, for instance air and gas, or to a same source of gaseous fluid, for example air. This engine may be operated as a Diesel engine, or as a compound Diesel/gas engine, or alternatively as a gas engine, without requiring any replacement of the cylinder-head and/or the gear controlling the inlet valves.

8 Claims, 5 Drawing Figures

INTERNAL COMBUSTION ENGINE OF THE TYPE HAVING TWO INLET VALVES PER CYLINDER

This is a continuation of my copending application Ser. No. 635,913 filed Nov. 28, 1975 now abandoned.

BACKGROUND OF THE INVENTION

Field of the Invention

The present invention relates in general to internal combustion engines comprising two inlet valves per cylinder, actuated by a single common rocker, the inlet ports formed jointly by the pair of valves and their seats communicating via an induction duct formed in the cylinder head with an external source of gaseous fluid.

Diesel engines comprising two air inlet valves per cylinder are already known, wherein the pair of inlet valves are actuated simultaneously by a single rocker common to both inlet valves. In an engine of this character, the pair of inlet valves communicates via a common induction passage formed in the cylinder head with an air induction manifold either cast integrally with the cylinder head or disposed externally of the cylinder head and connected thereto.

On the other hand, compound Diesel-gas engines are also known which comprise two inlet valves each connected via a separate induction duct or passage to a separate source of fluid, such as an air source and a source of gaseous fuel, respectively. However, in this type of engine the pair of inlet valves has generally different diameters, for example the air induction valve has a relatively great diameter and the gas induction valve has a smaller diameter. Moreover, in engines of this type the two inlet valves for the air and gas respectively are actuated by separate, different rockers.

Besides, internal combustion engines are also known which operate only on gaseous fuel. As a rule, these engines comprise only one inlet valve per cylinder, the inlet port being connected to an induction manifold. In this case, the air/fuel mixture is formed either upstream of the induction manifold or within this manifold by means of an auxiliary valve through which gas can be injected into said manifold.

From the foregoing, it is clear that for the three types of engines broadly described hereinabove different cylinder heads and also different gears or mechanisms for actuating the various inlet valves must be contemplated.

SUMMARY OF THE INVENTION

It is the essential object of the present invention to avoid this inconvenience by providing an internal combustion engine of which the cylinder head and the inlet valve gear can be utilized without any modification in a Diesel engine operated only on gasoil, or in a compound Diesel-gas engine operated both on gasoil and gaseous fuel, or alternatively in an engine operated only on gaseous fuel.

To this end, the invention provides an internal combustion engine of the type comprising for each cylinder a pair of inlet valves actuated by a single rocker, both inlet valves and their relevant seats forming in each cylinder two inlet ports communicating each with a corresponding induction manifold via a respective induction duct formed in the engine cylinder-head, whereby one of said induction manifolds can be always supplied with air, while the other induction manifold can be supplied either with air or with fluid fuel, according to the mode of operation of the engine.

According to a preferred embodiment of the present invention, for a given pair of inlet valves associated with a same cylinder each induction duct may consist of a separate passage formed in the cylinder-head. According to a modified construction, the two induction ducts associated with a same cylinder may consist of a single inlet passage formed in the cylinder-head and provided with an inner partition separating the two ducts from each other and cast integrally with the cylinder-head.

With this specific arrangement, the two induction ducts may be connected to a same external manifold or to a pair of external manifolds connected in turn to a same source of air if the engine is to operate according to the Diesel cycle on gasoil. When it is desired to operate the engine according to the compound gaseous/gas Diesel cycle, it is only necessary to connect one of said two induction ducts to a first external manifold connected in turn to a source of gas, and to connect the other induction ducts of the pair to a second external manifold connected in turn to a source of air. Finally, when it is desired to operate the engine as a gas engine supplied only with gas, it is only necessary to connect one of the two induction ducts to a first external manifold connected in turn to a source of gas while the other induction duct is connected to a second external manifold connected in turn to a source of air. Moreover, in this last instance an ignition spark plug should be substituted for the conventional gasoil injection system generally provided for operating a Diesel engine or a compound Diesel-gas engine, said ignition plug being adapted in combination with a suitable ignition distributor, to generate sparks for igniting the air-gas mixture introduced into the cylinder. On the other hand, it will be seen that in a gas-operated engine the air and gas are introduced separately into the cylinder so that the air-gas mixture is formed therein, which is much preferable than mixing air and gas within the induction manifold as in most conventional arrangements.

A detailed description of various embodiments of this invention will now be described by way of example with reference to the attached drawings, in which:

DESCRIPTION OF THE PREFERRED EMBODIMENTS

Figure 1:
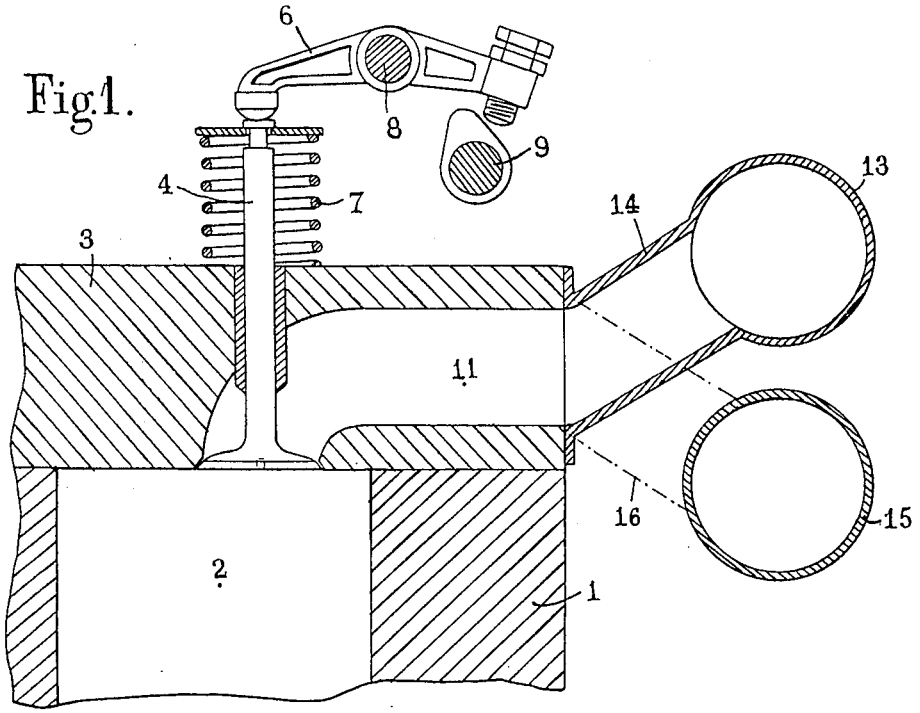
FIG. 1 is a diagrammatic fragmentary vertical section showing an internal combustion engine constructed according to the techings of the invention.
Figure 2:
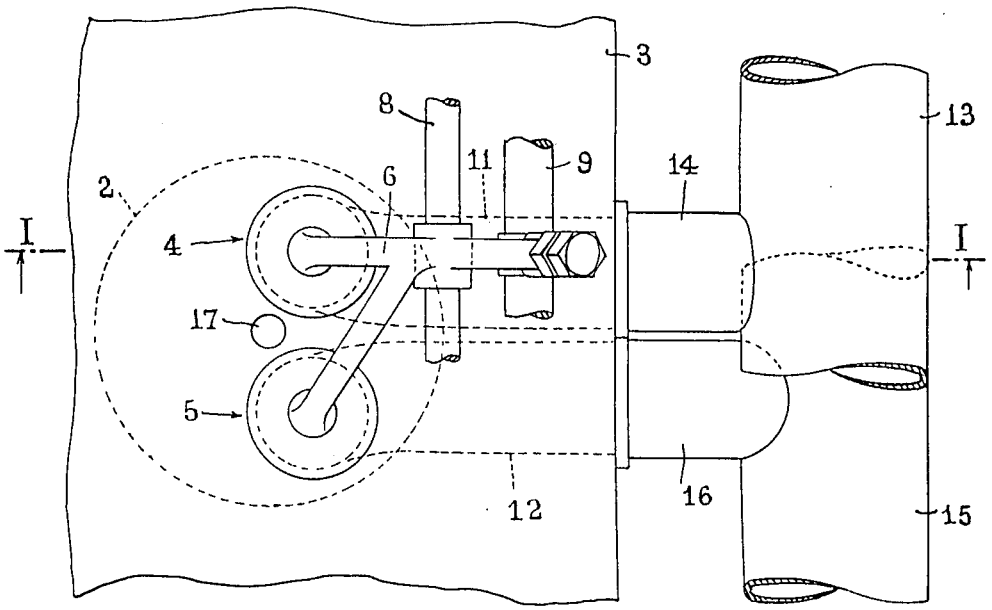
FIG. 2 is a diagrammatic fragmentary plan view from above of the engine illustrated in FIG. 1.

Referring first to FIGS. 1 and 2 of the drawings, there is shown diagrammatically an internal combustion engine according to this invention which comprises a cylinder-block or like casting or case 1, constructed in any suitable and known manner and comprising at least one cylinder 2. To this cylinder-block 1 a cylinder-head 3 is rigidly secured with the interposition of a suitable gasket (not shown).

As illustrated more particularly in FIG. 2, each cylinder comprises two inlet valves 4 and 5 having preferably the same diameter or substantially the same diameter; these inlet valves 4,5 are actuated by means of a single common rocker 6. Each inlet valve 4,5 is constantly urged to its seated or closed position by at least one valve spring 7. In the example illustrated in FIGS. 1 and 2, the rocker 6 controlling simultaneously the opening of both valves 4,5 is substantially fork-shaped and pivoted by means of a rocker shaft 8 mounted in a manner known per se in bearing blocks or bosses (not shown) secured to the cylinder-head 3.

As illustrated more in detail in FIG. 1, the rocker 6 is actuated directly by a camshaft 9 according to the conventional overhead camshaft valve disposal. However, it is obvious that the rocker 6 could be actuated in any other known and suitable manner, for example from a lateral camshaft controlling the rocker through a tappet and a push-rod.

According to a typical feature characterizing this invention, a separate induction duct designated by reference numeral 11 for valve 4 and by reference numeral 12 for valve 5 is provided for each inlet valve. Thus, the induction duct 11 may be connected to a first external manifold 13 via a connecting pipe 14 secured to one side of cylinder-head 3 and forming a lateral extension of said induction duct 11, the other induction duct 12 being connected if desired to another external manifold 15 via a connecting pipe 16 secured to the side of cylinder-head 3 and forming a lateral extension of said induction duct 12.

With this arrangement, when the engine is to be operated according to the Diesel cycle with gasoil fuel, both manifolds 13 and 15 may be connected to a same and common source of air. In this case, a single induction manifold connected to both pipes 14 and 16 may be substituted for the pair of induction manifolds 13 and 15. If the engine is to be operated according to the compound Diesel-gas cycle, the first manifold 13 may be connected to a source of gaseous fuel and the other manifold 15 may be connected for instance to a source of air. Finally, if the engine is to be operated with gaseous fuel, the induction manifolds 13 and 15 may be connected the one to a source of gas and the other to a source of air as in the case of a compound Diesel-gas engine.

In addition, the cylinder-head 3 comprises in registration with each cylinder 2 a tapped hole 17 disposed for example coaxially to the cylinder 2 and adapted to receive a gasoil injection nozzle or like device (not shown) if the engine is to operate according to the Diesel cycle or to the compound Diesel-gas cycle; alternatively, an ignition spark plug (not shown) may be fitted in said tapped hole 17 if the engine is to be gas-operated.

Also associated with each cylinder 2 in a manner known per se are exhaust valves (not shown) mounted in the cylinder-head 3 and controlling exhaust ports and ducts formed in said cylinder-head. These exhaust valves may be controlled in the known, conventional manner. Therefore, inasmuch as the specific disposal of these exhaust valves is no part of the present invention, these exhaust valves are not shown in the drawings to avoid any unnecessary encumbering thereof. Preferably, two exhaust valves per cylinder are provided.

If the engine is to be operated as a compound Diesel-gas engine or as a gas engine, to prevent any premature ignition of the fuel gas introduced into the cylinder or cylinders, the gas inlet valve of each cylinder may be a so-called cylindrical shutter type valve in a manner known per se. With a valve of this type it is possible to retard the ingress of fuel gas into the cylinder with respect to the actual opening of the air inlet valve operating in unison therewith. The use of this cylindrical shutter valve also permits of stopping the delivery of gas into the cylinder before said air inlet valve is actually closed.

Figure 3:
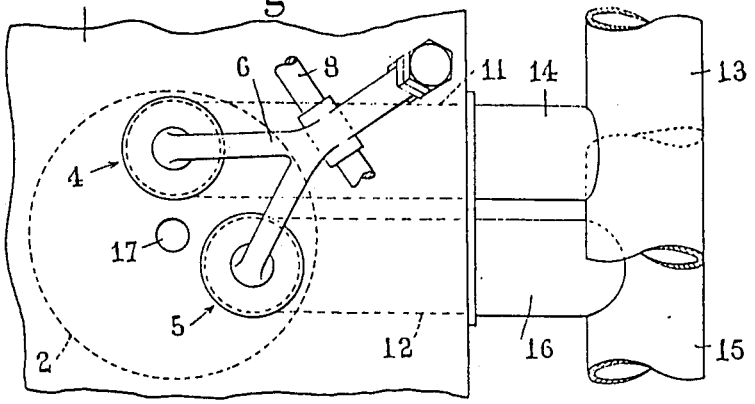
FIG. 3 is a diagrammatic fragmentary plan view from above showing a modified embodiment of the shown in FIGS. 1 and 2.

In the above-described embodiment illustrated in FIGS. 1 and 2 both valves 4 and 5 and both induction ducts 11 and 12 formed in the cylinder-head 3 are disposed symmetrically in relation to the vertical plane containing the axis of cylinder 2 at right angles to the longitudinal axis of the engine, and the rocket 6 has the shape of an asymmetrical "Y", as shown in FIG. 2. However, the pair of inlet valves 4 and 5 may be disposed in a manner known per se asymmetrically in relation to the above-mentioned plane, and the rocker 6 may have the shape of a symmetrical "Y" as illustrated in FIG. 3 in which similar components or components having the same function as in FIGS. 1 and 2 are designated by the same reference numerals.

Figure 4:
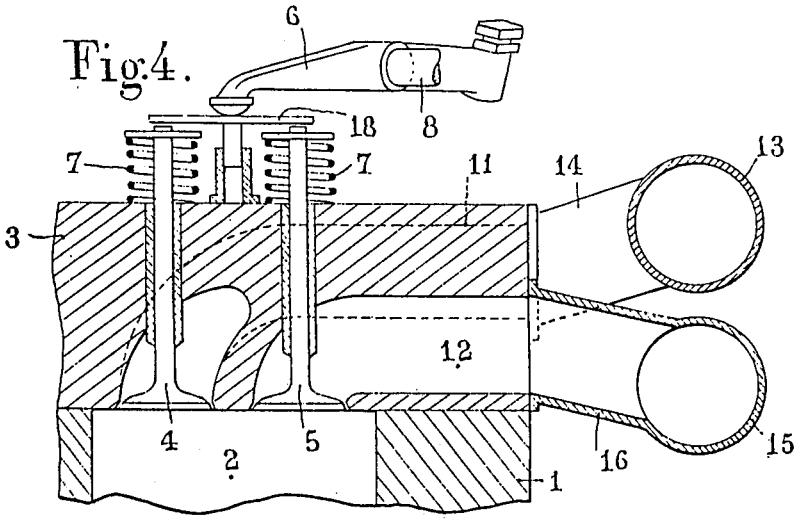
FIG. 4 is a fragmentary diagrammatic plan view showing another modified embodiment of the engine according to this invention.
Figure 5:
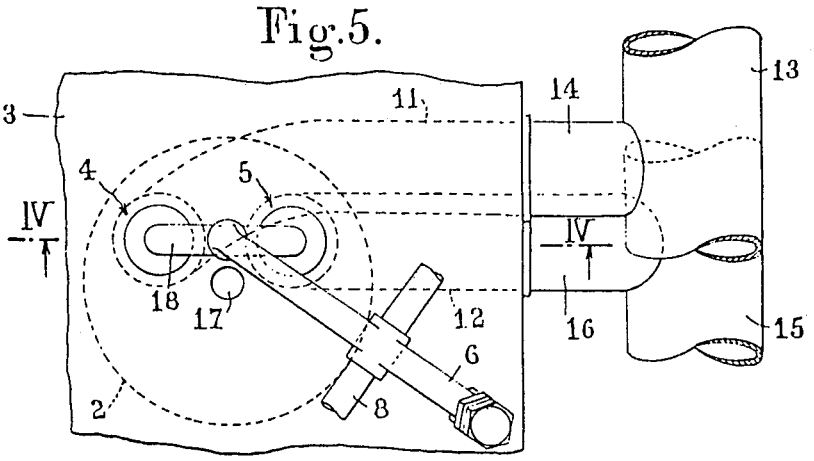
FIG. 5 is a diagrammatic fragmentary plan view from above of the engine shown in FIG. 4.

FIGS. 4 and 5 illustrate another modified embodiment of the engine of this invention wherein the pair of inlet valves 4 and 5 are disposed in a manner known per se in a common transverse vertical plane in relation to the longitudinal axis of the engine. Moreover, in these modified forms of embodiment the pair of inlet valves 4,5 are actuated by a single rocker through a coupling member 18 bridging the two valves. In FIGS. 4 and 5 the components having the same functions as those of FIGS. 1 and 2 are designated by the same reference numerals.

Of course, the specific embodiments described, illustrated and/or suggested herein should not be construed as limiting the scope of the invention since they are given by way of illustration, not of limitation, so that many modifications and changes may be brought thereto without departing from the basic principles of the invention as set forth in the appended claims. Thus, notably, the inlet ducts 11 and 12 formed in the cylinder-head may consist either of a pair of separate ducts or of a main duct provided with an internal partition separating the two induction ducts from each other and cast integrally with the cylinder-head, each induction duct leading to a relevant inlet port determined by one of the pair of inlet valves and the corresponding valve seat formed in the cylinder-head. Likewise, instead of providing two separate manifolds 13 and 15, the arrangement may comprise a "twin" manifold having an internal partition providing two separate induction passages each adapted to be connected to one of the pair of induction ducts 11 and 12 formed in the cylinder-head. Moreover, instead of providing manifolds 13 and 15 in the form of separate members secured to the cylinder-head 3, said manifolds may be cast integrally with the cylinder-head.

What I claim is:

1. An internal combustion engine comprising (a) a cylinder block; (b) at least one cylinder in said cylinder block; (c) a cylinder head having first and second inlet ports opening into said at least one cylinder, at least one induction passage, and first and second induction ducts formed in said at least one induction passage, each induction duct being connected with one of said inlet ports; (d) first and second inlet valves, each inlet valve being adapted to close one of said inlet ports, said second inlet valve being a cylindrical shutter-type valve; (e) a single rocker for actuating simultaneously said first and second inlet valves; and (f) first and second induction manifolds, each induction manifold being connected to one of said induction ducts, said first induction manifold being connected to a source of air, and said second induction manifold being detachably connected to a source of gaseous fuel.

2. An internal combustion engine as set forth in claim 1 wherein said first and second inlet valves have substantially the same diameter.

3. An internal combustion engine as set forth in claim 1 wherein said cylinder head includes first and second induction passages, and wherein said first and second induction ducts are formed in said first and second induction passages, respectively.

4. An internal combustion engine as set forth in claim 1 wherein said cylinder head includes one induction passage, and wherein said first and second induction ducts are formed in said induction passage, said induction passage having an internal partition separating said first and second induction ducts from one another, said partition being cast integrally with the cylinder head.

5. An internal combustion engine as set forth in claim 1 further including a twin manifold, and wherein said first and second induction manifolds are formed in said twin manifold, said twin manifold having an internal partition separating said first and second induction manifolds from one another.

6. An internal combustion engine as set forth in claim 1 wherein the cylinder head further includes a tapped hole aligned coaxially with said at least one cylinder and adapted to receive one of the elements of the group comprising a gasoil injection device and an ignition spark plug.

7. An internal combustion engine as set forth in claim 1 wherein said rocker has a forked configuration with two rocker arms, each rocker arm adapted to actuate one of said inlet valves.

8. An internal combustion engine as set forth in claim 1 wherein the rocker associated with said first and second inlet valves comprises a two-armed lever with a driving arm and a driven arm, and a bridging member situated between the driving arm of said rocker and said first and second inlet valves, said bridging member being adapted to be acted upon, intermediate its ends, by said rocker driving arm.

* * * * *